United States Patent [19]

Dykema et al.

[11] Patent Number: 4,848,781

[45] Date of Patent: Jul. 18, 1989

[54] PIVOTING DECK SNOW BOARD

[76] Inventors: Robert A. Dykema, 4110 Gateside Rd., La Mesa, Calif. 92041; Stanley A. Pleskunas, 4456 Cape May Ave., San Diego, Calif. 92107

[21] Appl. No.: 180,991

[22] Filed: Apr. 13, 1988

[51] Int. Cl.[4] ..... B62B 17/04; B62B 13/04

[52] U.S. Cl. ..... 280/14.2; 280/28.16; 280/22.1

[58] Field of Search ..... 280/600, 601, 607, 608, 280/609, 11.12, 11.14, 11.18, 12 HO, 12 LX, 17, 21 R, 21 AX, 27, 87.04 A

[56] References Cited

U.S. PATENT DOCUMENTS

| | | | |
|---|---|---|---|
| 3,343,847 | 9/1967 | Christy | 280/12 H |
| 3,782,744 | 1/1974 | Milovich et al. | 280/12 H X |
| 4,068,861 | 1/1978 | Zemke, Jr. | 280/608 X |
| 4,398,734 | 8/1983 | Barnard | 280/87.04 A X |
| 4,433,855 | 2/1984 | Wyke | 280/609 |

FOREIGN PATENT DOCUMENTS

| | | | |
|---|---|---|---|
| 2405722 | 6/1979 | France | 280/12 H |
| 2420984 | 11/1979 | France | 280/12 H |
| 2423243 | 12/1979 | France | 280/12 H |
| 2428452 | 2/1980 | France | 280/12 H |

*Primary Examiner*—Charles A. Marmor
*Assistant Examiner*—Tamara L. Finlay
*Attorney, Agent, or Firm*—Baker, Maxham, Jester & Meador

[57] ABSTRACT

A snow board comprises a runner and a support deck pivotally supported on and above the runner for pivoting about a longitudinal axis thereof.

20 Claims, 1 Drawing Sheet

FIG. 1
PRIOR ART
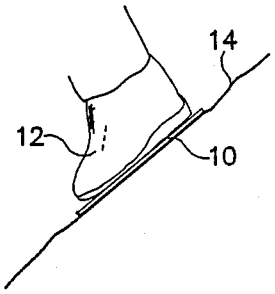
FIG. 2
PRIOR ART
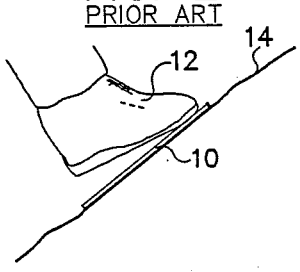
FIG. 3
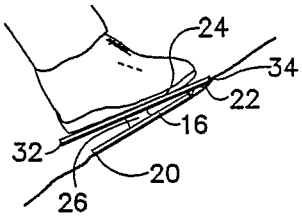
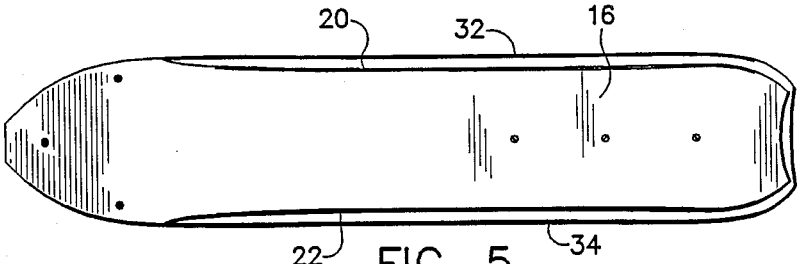
FIG. 5
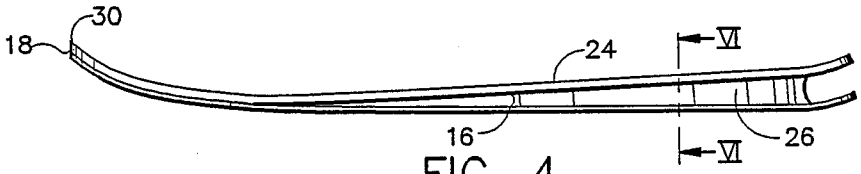
FIG. 4
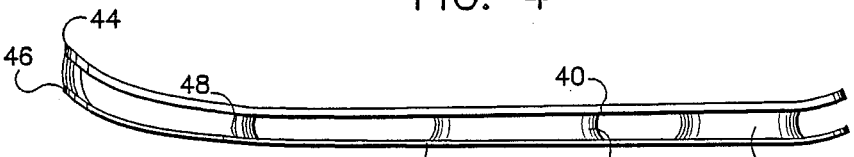
FIG. 7
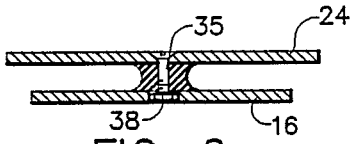
FIG. 6
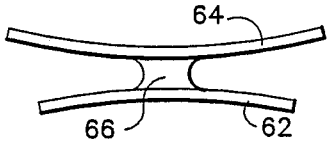
FIG. 9
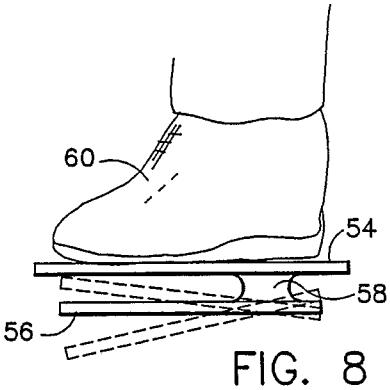
FIG. 8

PIVOTING DECK SNOW BOARD

BACKGROUND OF THE INVENTION

The present invention relates to the sport of snow boarding and pertains particularly to improved snow boards.

The traditional sport of skiing is carried out on a pair of skis, which comprises a pair of elongated runners, each separately attached to a separate foot of the skier for the purpose of supporting a skier on the snow surface to enable sliding along the surface thereof on skis. Skis are used both for cross-country and downhill travel.

There has been recently introduced a sport known as ski or snow boarding wherein the skier utilizes a single wide runner, several times wider than the traditional ski, and stands sideways or crossways of the board, facing to one side with one foot before the other, and travels along a ski slope in a manner similar to that of a surfer or a skate boarder. The snow boards typically consist of a single panel formed in the general shape of a traditional ski, but typically the same length and much wider to enable the skier's feet to extend transverse to the axis of the board.

As in any skiing, it is desirable to traverse the slopes, particularly steep slopes in order to maintain some reasonable control on the speed or velocity of the skier. Typical snow boards are difficult to maneuver in this fashion for the reasons as illustrated in FIGS. 1 and 2. When the skier is traversing the hill or slope, such that he stands with his toe pointed downhill facing downhill (FIG. 1), it is much easier to accomplish or obtain the necessary bending of the ankles and/or knees to maintain the snow board reasonably supported on the surface of the snow. However, when the skier faces uphill as shown in FIG. 2, it is difficult to maintain the feet in contact with the upper surface of the board, and at the same time maintain the lower surface of the snow board in contact with the surface of the snow. For this reason, it is difficult for the snow boarder to maintain good control of his board during his run.

The applicants have devised a modification in snow boards which overcomes the above problems, and provides numerous improvements in the snow board.

SUMMARY AND OBJECTS OF THE INVENTION

It is the primary object of the present invention to overcome the above problems of the prior art.

In accordance with the primary aspect of the present invention, a snow board includes a runner and a support deck, spaced and supported above the runner, with means enabling the deck and runner to pivot relative to one another along a longitudinal axis thereof.

BRIEF DESCRIPTION OF THE DRAWING

The above and other objects and advantages of the present invention will become apparent from the following description when read in conjunction with the drawings wherein:

FIG. 1 is an end elevational view showing one position of a snow boarder in accordance with the prior art;

FIG. 2 is a view like FIG. 1 showing the opposite orientation of the snow boarder on a snow board as in FIG. 1;

FIG. 3 is an end view like FIG. 2 of a preferred embodiment of the present invention;

FIG. 4 is a side elevation view of the embodiment of FIG. 3;

FIG. 5 is a bottom view of the embodiment of FIG. 3;

FIG. 6 is a section view taken generally on FIG. 6—6 of FIG. 4;

FIG. 7 is a side elevation view like FIG. 4 of a further embodiment of the invention;

FIG. 8 is an end view like FIG. 3 showing an alternate embodiment of the invention; and FIG. 9 is an end view showing still another embodiment of the invention.

DETAILED DESCRIPTION OF A PREFERRED EMBODIMENT

In order to more fully understand the present invention, an example of the prior art is illustrated, and will be described in conjunction with the description of the present invention. Referring specifically to FIGS. 1 and 2, there is illustrated a snow board 10 of conventional construction, which normally comprises a substantially flat panel, with an upturned forward end and a slightly upturned rear end having a width sufficient to accommodate feet 12 of an individual extending transverse thereto. The board rests on a sloping snow formation 14 in a manner to show traversing of the slope. In the FIG. 1 illustration, the skier's feet 12 are pointed downhill or down slope, with the feet shown resting on the upper surface of the board. The lower surface of the board is seen resting on the surface of the snow formation 14, and extending in a direction transverse to the slope. The snow boarder can bend his knees and ankles to accommodate the degree of slope.

Referring to FIG. 2, the same snow board 12 rests in a similar position on the slope 14, and may be traversing the slope in the same or opposite direction, with the skier and his feet 12 facing up slope. As shown therein, the snow board 10 rests on the surface of the slope 14. However, the lower surface of the skier's feet 12 are somewhat spaced from the upper surface of the board on the downhill side thereof, because of the limitations of pivoting of the human ankles. It is difficult for a skier to maintain complete and proper control of the board while traversing the slope with only the toes in contact with the board in this fashion. It will be recalled that in traversing a slope, the skier will normally traverse the slope by alternately facing downhill and uphill as he goes in alternate directions.

Referring to FIG. 3, there is illustrated a preferred embodiment of a snow board constructed in accordance with the invention. In the illustrated embodiment, a first or lower panel 16 forms the runner and has an upturned front or forward end 18 and side edges 20 and 22. The panels may also have a slightly upturned rear end. A second or upper panel forming a support deck 24 is supported above and connected to the lower panel by a connecting means 26, for enabling the upper or support deck 24 to pivot along a longitudinal axis of the two panels. The upper panel is shaped in a manner somewhat similar to the lower panel, but as illustrated is preferably wider and similarly curves upward at the forward end 30, and in the illustrated embodiment is secured either by screws, bolts or bonding directly to the forward end 18 of the lower panel 16. The upper panel 24 is also preferably formed of side edges 32 and 34. The side edges 20 and 22 of the lower panel are preferably provided with metal inserts similar to those of skis to provide a sharp edge thereof. The edges 32 and 34 of the upper panel may also be provided with such metal edges. These enable the snow board to dig into the snow surface to support the runner in a turn, particularly on hard pack or ice.

The panels are preferably constructed of a laminated construction, such as plywood, fiberglass, or combinations thereof, so that they are light, thin and strong. The lower panel will preferably be constructed somewhat along the lines of a conventional ski, with a wood laminated construction and a runner surface, which may be of a material to enhance the sliding of the runner on the snow surface. In addition, the runner may be preferably provided with metal edges, which can be sharpened to provide a gripping edge in the manner such as skis.

The connecting means 26 between the upper and lower panels is preferably an elastomeric material and may be in the form of a single member, a plurality of members or an elongated continuous member having a thickness to support the panels apart, at least along the horizontal surfaces thereof, and have a width to enable the panels to pivot relative to one another as illustrated in FIG. 3.

The elastomeric material is also preferably of a type such that compression thereof may increase the resistance thereof to bending, such that adjustment means, as illustrated for example in FIG. 6, may be provided. In this manner, a threaded shaft or screw 35 extends downward through the top panel 24, and extends into a nut or the like 38 embedded in the runner or lower panel 16. Thus, rotation of the screw 35 results in tightening or loosening the compression between the boards, and thereby adjusting the ease and/or degree of tilt available between the upper and lower panels.

The panels can be constructed of laminated plywood or laminated fiberglass or combinations thereof. The lower panel or runner 16, as shown in FIG. 5, is preferably constructed with a front end thereof that curves outward to a width substantially equal to that of the upper panel 24, and thereafter converges or reduces inward to a width as illustrated wherein the lower panel may be on the order of from about two-thirds to about three-quarters of the width of the upper panel.

Referring to FIG. 7, there is illustrated an embodiment wherein an upper panel 40 is supported above and connected to a lower panel 42, in a manner somewhat similar to that in FIG. 4, with two principal exceptions. One exception is that forward ends of panel 44 of panel 40 and forward end of 46 of panel 42 are spaced apart by an elastic member 48. In addition, the elastic means suspending the boards apart comprises a plurality of elastic members 48, 50 and 52 positioned along the length of the board. This can provide variations in the flexibility and the construction of the board.

Referring to FIG. 8, an alternatively construction is illustrated wherein an upper panel 54 is mounted and secured above a lower panel 56 by an elastic member 58, which is disposed off center from the longitudinal center of the boards. The elastic member is preferably positioned off center to an extent to lie directly beneath the ankle of a skier's foot 60 resting on the upper panel 54. This can provide improved handling and tilting ability, because the skier's ankle and the pivot are aligned. This places the pivoting between the boards directly beneath the ankles of the skier (in one orientation of the skier), and in addition it increases the degree of tiltability of the boards, particularly when facing downhill. The lower panel can tilt, as shown in phantom, from an asymmetric tilt or pivot axis. This has been to found to provide an improved or enhanced handling ability in certain instances.

Referring to FIG. 9, a still further embodiment of the invention is illustrated wherein a runner 62 has a curved or concave configuration on the running surface, with the support panel or platform 64 having a similar curved configuration. Advantages can be achieved by having at least one of the panels with the illustrated curved configuration. This enhances the degree of pivotability between the boards, with the maximum pivotability being achieved by the two curved panels as illustrated. The curve of the lower panel or runner also gives a better bite.

While we have illustrated and described our invention by means of specific embodiments, it is to be understood that numerous changes and modifications may be made therein without departing from the spirit and scope of the invention as defined in the appended claims.

We claim:

1. A snow board comprising:

a first elongated panel defining a runner surface;

a second panel defining a support deck disposed above said first panel; and means for connecting said first and second panels together in vertically spaced relations for enabling relative pivoting thereof along a substantially longitudinal axis therebetween so that said first and second panels maintain a constant longitudinal orientation therebetween.

2. A snow board according to claim 1 wherein:

said means connecting said panels comprises elastic means.

3. A snow board according to claim 2 wherein:

said elastic means has a width less than that of either panel.

4. A snow board according to claim 3 wherein:

said elastic means separates said panels along the entire longitudinal axis thereof.

5. A snow board according to claim 1 wherein:

said panels each have a front end and a rear end, said front ends curve upward and are secured together in direct surface to surface engagement along a front edge.

6. A snow board according to claim 1 wherein:

said panels are spaced apart along the entire length thereof.

7. A snow board according to claim 1 wherein:

said first panel has a width that is less than that of said second panel.

8. A snow board according to claim 1 wherein:

said first panel has means defining a sharp edge along each side thereof.

9. A snow board according to claim 1 wherein:

each of said panels has means defining a sharp edge along each side thereof.

10. A snow board according to claim 1 wherein: at least one of said panels is curved about a longitudinal axis thereof.

11. A snow board comprising:

a first elongated panel defining a runner surface;

a second panel defining a support deck disposed above said first panel;

means for connecting said first and second panels together in vertically spaced relations for enabling relative pivoting thereof along a substantially longitudinal axis;

said means connecting said panels comprises elastic means;

said elastic means has a width less than that of either panel; and said elastic means extends between said panels along a line spaced to one side of the longitudinal axis thereof.

12. A pivotal deck snow board comprising:

an elongated runner having upper and lower surfaces, an upturned front end and longitudinally extending side edges;

an elongated generally planar support deck disposed above said runner; and pivotal connecting means for connecting said first and second panels together in vertically spaced relations at spaced positions along a substantially longitudinal axis defining a substantially longitudinal pivot axis therebetween for enabling relative pivoting thereof along said substantially longitudinal axis.

13. A snow board according to claim 12 wherein:

said connecting means comprises elastic means having a width less than that of either of said runner and said support deck.

14. A snow board according to claim 12 wherein:

said runner has a width that is less than that of said support deck; and at least said runner has means defining a sharp edge along each side thereof.

15. A snow board according to claim 14 wherein:

said elastic means separates said runner and said support deck along the entire longitudinal axis thereto.

16. A snow board according to claim 14 wherein:

at least one of said panels is curved about a longitudinal axis thereof.

17. A snow board comprising:

an elongated runner having upper and lower surfaces, an upturned front end and longitudinally extending side edges;

an elongated generally planar support deck disposed above said runner;

pivotal connecting means for connecting said first and second panels together in vertically spaced relations along a longitudinal axis for enabling relative pivoting thereof along said substantially longitudinal axis; and said elastic means extends between said panels along a line spaced to one side of the longitudinal axis thereof.

18. A pivotal deck snow board comprising:

an elongated runner having upper and lower surfaces, an upturned front end and longitudinally extending sharp metal side edges;

an elongated generally planar support deck having a length about equal to that of said runner and a width exceeding that of said runner disposed above said runner; and pivotal elastic connecting means having a width less than that of either of said runner and said support deck for connecting said first and second panels together in vertically spaced relations along a longitudinal axis therebetween for enabling relative pivoting thereof along said substantially longitudinal axis.

19. A snow board according to claim 18 wherein:

said connecting means comprises means for adjusting the stiffness of said elastic means.

20. A snow board comprising:

an elongated runner having upper and lower surfaces, an upturned front end and longitudinally extending sharp metal side edges;

an elongated generally planar support deck having a width exceeding that of said runner disposed above said runner;

pivotal elastic connecting means having a width less than that of either of said runner and said support deck for connecting said first and second panels together in vertically spaced relations along a longitudinal axis for enabling relative pivoting thereof along said substantially longitudinal axis; and said elastic means extends between said panels along a line spaced to one side of the longitudinal axis thereof.

* * * * *